US009368055B2

(12) United States Patent
Choi et al.

(10) Patent No.: US 9,368,055 B2
(45) Date of Patent: Jun. 14, 2016

(54) DISPLAY DEVICE AND DRIVING METHOD THEREOF FOR IMPROVING SIDE VISIBILITY

(71) Applicant: SAMSUNG DISPLAY CO., LTD., Yongin, Gyeonggi-do (KR)

(72) Inventors: Nam-Gon Choi, Yongin-si (KR); Joon-Chul Goh, Hwaseong-si (KR); Gi Geun Kim, Seoul (KR); Yun Ki Baek, Suwon-si (KR); Yong Jun Jang, Yongin-si (KR); Ah Reum Kim, Hwaseong-si (KR); Geun Jeong Park, Daegu (KR); Cheol Woo Park, Suwon-si (KR); Jeong-Hun So, Hwaseong-si (KR); Dong Gyu Lee, Seoul (KR)

(73) Assignee: Samsung Display Co., Ltd. (KR)

( * ) Notice: Subject to any disclaimer, the term of this patent is extended or adjusted under 35 U.S.C. 154(b) by 139 days.

(21) Appl. No.: 14/177,089

(22) Filed: Feb. 10, 2014

(65) Prior Publication Data

US 2015/0049123 A1 Feb. 19, 2015

(30) Foreign Application Priority Data

Aug. 19, 2013 (KR) ..... 10-2013-0098010

(51) Int. Cl.
*G09G 5/10* (2006.01)
*G09G 3/20* (2006.01)

(52) U.S. Cl.
CPC ..... *G09G 3/2003* (2013.01)

(58) Field of Classification Search
CPC ..... G09G 5/10; G09G 5/00; G06F 3/038; G06K 9/00; G06K 9/34; G06K 9/36; G06K 9/38; G06K 9/18; G06K 9/46; G06K 9/66; G06K 9/50; G06K 9/48
See application file for complete search history.

(56) References Cited

U.S. PATENT DOCUMENTS

2007/0110305 A1* 5/2007 Corcoran ..... G06T 5/00 382/167
2010/0172579 A1* 7/2010 Reid ..... G06K 9/036 382/165
2011/0134275 A1* 6/2011 Nguyen ..... G06K 9/00234 348/223.1
2013/0129209 A1* 5/2013 Reid ..... G06K 9/00234 382/165

(Continued)

FOREIGN PATENT DOCUMENTS

KR 10-2007-0115621 12/2007
KR 10-2008-0045175 5/2008

(Continued)

OTHER PUBLICATIONS

Phung et al., Skin segmentation using color pixel classification: analysis and comparison (IEEE) IEEE Transactions on Pattern Analysis and Machine Intelligence, vol. 27, No. 1, Jan. 2005.

*Primary Examiner* — Pegeman Karimi
(74) *Attorney, Agent, or Firm* — Innovation Counsel LLP

(57) ABSTRACT

A display device includes: a similar gray level block detector configured to detect a pixel data block in which a gray level difference between a plurality of pixel data included in an image signal is smaller than or equal to a threshold; a skin tone detector configured to detect the pixel data block including a skin tone; and a gamma processor configured to apply a first gamma to a plurality of pixel data included in the pixel data block when the pixel data block does not include the skin tone and apply a second gamma to the plurality of pixel data included in the pixel data block when the pixel data block includes the skin tone.

20 Claims, 17 Drawing Sheets

(56) References Cited

U.S. PATENT DOCUMENTS

2013/0329997 A1* 12/2013 Webb ..... G06T 5/007
382/167
2014/0147057 A1* 5/2014 Zhai ..... G06T 5/20
382/266

FOREIGN PATENT DOCUMENTS

KR 10-2009-0079108 7/2009
KR 10-2010-0011464 2/2010
KR 10-2011-0126862 11/2011
KR 10-2013-0134567 12/2013

* cited by examiner

DISPLAY DEVICE AND DRIVING METHOD THEREOF FOR IMPROVING SIDE VISIBILITY

CROSS-REFERENCE TO RELATED APPLICATION

This application claims priority to and the benefit of Korean Patent Application No. 10-2013-0098010 filed in the Korean Intellectual Property Office on Aug. 19, 2013, the entire contents of which are incorporated herein by reference.

BACKGROUND (a) Field

Embodiments of the inventive concept relates to a display device and a driving method thereof, and more particularly, to a display device and a driving method thereof capable of improving side visibility.

(b) Description of the Related Art

A liquid crystal display is one of the widely used flat panel displays currently, and includes two display panels on which electric field generating electrodes such as a pixel electrode and a common electrode are formed, and a liquid crystal layer between the two display panels. An image is displayed by applying a voltage to the electric field generating electrodes to generate an electric field in the liquid crystal layer. The applied voltage determines orientation of liquid crystal molecules of the liquid crystal layer through the generated electric field, and controls polarization of incident light.

Among liquid crystal displays, a vertically aligned mode liquid crystal display of which a long axis of the liquid crystal molecule is aligned to be orthogonal to the display panel in a state where the electric field is not generated is widely used.

The vertically aligned mode liquid crystal display displays an image having a desired gray level by controlling a slope of the long axis of the liquid crystal molecule from a vertical direction to a horizontal direction through the electric field. While an image having a desired gray level is viewed at the front of the vertically aligned mode liquid crystal display, an image having an undesired gray level is viewed at the side of the vertically aligned mode liquid crystal display because a path of light pass through the liquid crystal molecule is different between a front view and a side view. That is, light transmission at the side is lower than light transmission at the front when an image having a high gray level is displayed in the vertical aligned mode liquid crystal display, and the light transmission at the side is higher than the light transmission at the front when an image having a low gray level is displayed.

The above information disclosed in this Background section is only for enhancement of understanding of the background of the invention and therefore it may contain information that does not form a prior art.

SUMMARY

Embodiments of the inventive concept have been made in an effort to provide a display device and a driving method thereof capable of improving side visibility.

An exemplary embodiment of the inventive concept provides a display device including: a similar gray level block detector configured to detect a pixel data block in which a gray level difference between a plurality of pixel data included in an image signal is smaller than or equal to a threshold; a skin tone detector configured to detect the pixel data block including a skin tone; and a gamma processor configured to apply a first gamma to a plurality of pixel data included in the pixel data block when the pixel data block does not include the skin tone and apply a second gamma to the plurality of pixel data included in the pixel data block when the pixel data block includes the skin tone.

The first gamma may be a single gamma including one gamma.

The second gamma may be a multi gamma including a plurality of gammas.

The gamma processor may apply different gammas to a plurality of subpixel data included in each of the plurality of pixel data when the pixel data block includes the skin tone.

The gamma processor may apply a plurality of different first gammas to a plurality of subpixel data included in each of the plurality of pixel data during odd frames and apply a plurality of different second gammas to the plurality of subpixel data included in each of the plurality of pixel during even frames.

A product of the plurality of gammas may correspond to a reference gamma value.

Each of the plurality of pixel data may include a red gray level value, a green gray level value, and a blue gray level value, and the skin tone detector may detect the pixel data block as the pixel data block including the skin tone when the red gray level value is larger than the green gray level value and the red gray level value is larger than the green gray level value.

The skin tone detector may multiply the green gray level value and the blue gray level value by a predetermined correction parameter respectively and compare them with the red gray level value.

The display device may further include an HSV color space converter configured to convert an image signal to HSV data.

The skin tone detector may detect whether hue and saturation is within a predetermined skin tone range in the HSV data.

The skin tone detector may detect whether corresponding pixel data include the skin tone based on whether or not a color histogram of each of the plurality of pixel data is included in a color distribution range indicating the skin tone.

The display device may further include a still image detector configured to compare an image of a previous frame and an image of a current frame based on the image signal and detect whether a current image is a still image or a moving image.

When the current image is the still image, the gamma processor may apply a first gamma to the plurality of pixel data during odd frames and apply a second gamma to the plurality of pixel data during even frames.

When the current image is the moving image, the gamma processor applies different gammas to a plurality of subpixel data included in each of the plurality of pixel data.

The display device may further include an edge detector configured to detect an edge of an object having the skin tone in the pixel data block. A gamma processor is configured to apply one of a single gamma and a multi gamma to the pixel data block having the skin tone.

Another exemplary embodiment of the inventive concept provides a method of driving a display device, the method including: detecting a pixel data block in which a gray level difference between a plurality of pixel data included in an image signal is equal to or smaller than a threshold; detecting the pixel data block including a skin tone; applying a first gamma to a plurality of pixel data included in the pixel data block when the pixel data block does not include the skin tone; and applying a second gamma to the plurality of pixel data included in the pixel data block when the pixel data block includes the skin tone.

The applying the second gamma to the plurality of pixel data included in the pixel data block when the pixel data block includes the skin tone may include applying different gammas to a plurality subpixel data included in each of the plurality of pixel data.

The applying the second gamma to the plurality of pixel data included in the pixel data block when the pixel data block includes the skin tone may include applying a plurality of different first gammas to the plurality of subpixel data included in each of the plurality of pixel data during odd frames and applying a plurality of different second gammas to the plurality of subpixel data included in each of the plurality of pixel data during even frames.

The applying the second gamma to the plurality of pixel data included in the pixel data block when the pixel data block includes the skin tone may include applying the first gamma to the plurality of subpixel data included in each of the plurality of pixel data during odd frames and applying a second gamma to the plurality of subpixel data included in each of the plurality of pixel data during even frames.

The method may further include comparing an image of a previous frame and an image of a current frame based on an image signal and detecting whether a current image is a still image or a moving image, wherein the applying the second gamma to the plurality of pixel data included in the pixel data block when the pixel data block includes the skin tone may include applying the first gamma to the plurality of pixel data during odd frames and applying the second gamma to the plurality of pixel data during even frames when a current image is a still image.

The applying the second gamma to the plurality of pixel data included in the pixel data block when the pixel data block includes the skin tone may include applying different gammas to a plurality of subpixel data included in each of the plurality of pixel data when the current image is a moving image.

The side visibility of the image can be improved by selecting a portion having low side visibility and applying a multi gamma to the portion.

The side visibility can be more effectively improved by distinguishing between cases where the image is a moving image and the image is a still image and selectively applying a space division multi gamma and a time division multi gamma.

An optical viewing angle can be secured in a vertically aligned mode liquid crystal display.

DETAILED DESCRIPTION

Figure 1:
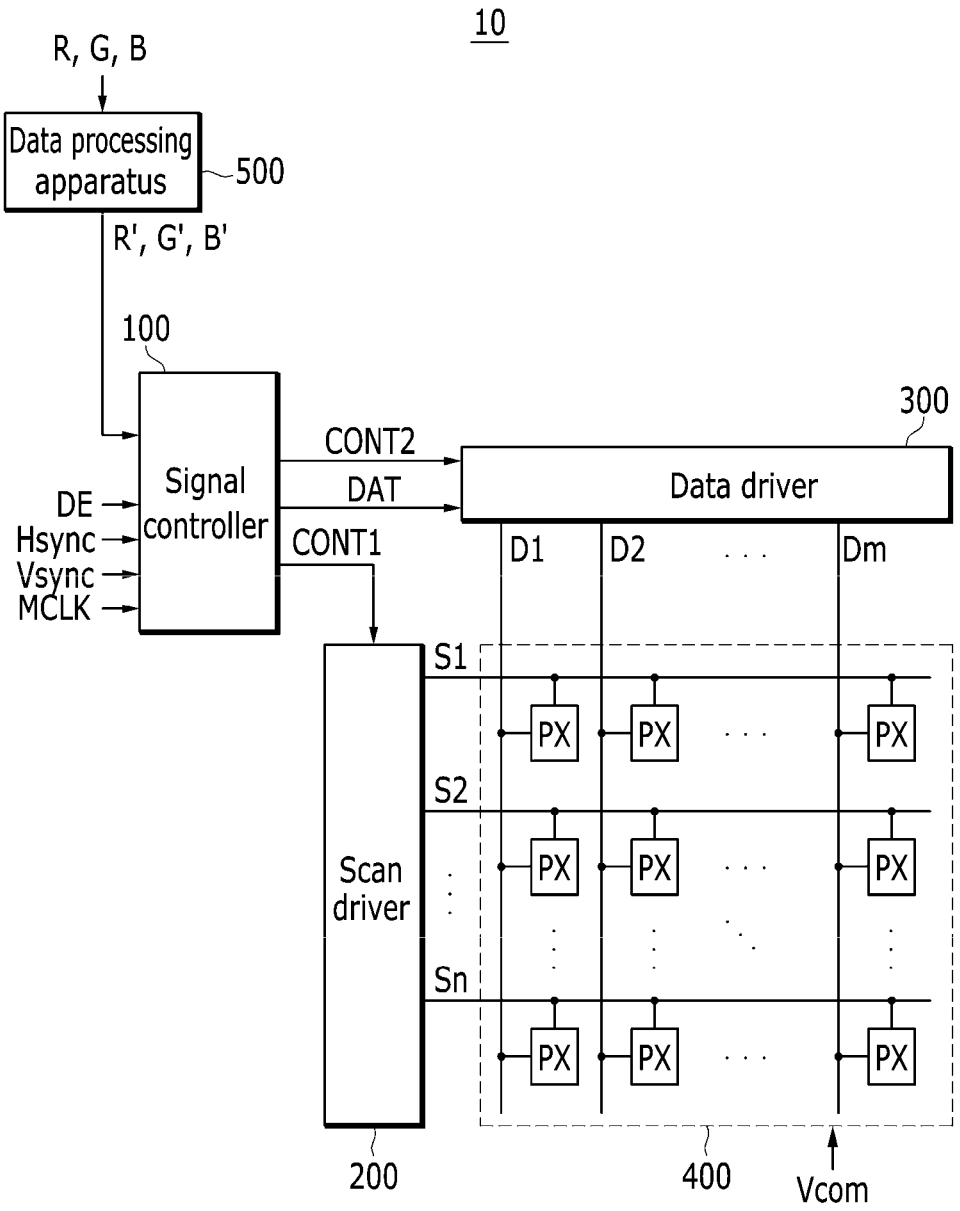
FIG. 1 is a block diagram illustrating a display device according to an exemplary embodiment of the inventive concept.

The inventive concept will be described more fully hereinafter with reference to the accompanying drawings, in which exemplary embodiments of the invention are shown. As those skilled in the art would realize, the described embodiments may be modified in various different ways, all without departing from the spirit or scope of the inventive concept.

Further, in exemplary embodiments, because like reference numerals designate like elements having the same configuration, a first exemplary embodiment is representatively described, and in other exemplary embodiments, only a configuration different from the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. Further, in the specification, unless explicitly described to the contrary, the word "comprise" and variations such as "comprises" or "comprising", will be understood to imply the inclusion of stated elements but not the exclusion of any other elements.

FIG. 1 is a block diagram illustrating a display device according to an exemplary embodiment of the inventive concept.

Referring to FIG. 1, a display device includes a signal controller 100, a scan driver 200, a data driver 300, a liquid crystal panel assembly 400, and a data processing apparatus 500.

The liquid crystal panel assembly 400 includes a plurality of pixels PX arranged approximately in a matrix form, a plurality of scan lines S1 to Sn, and a plurality of data lines D1 to Dm. The plurality of pixels PX are connected to the plurality of scan lines S1 to Sn and the plurality of data lines D1 to Dm respectively. The plurality of scan lines S1 to Sn extend approximately in a row direction and thus are substantially parallel to each other, and the plurality of data lines D1 to Dm extend approximately in a column direction and thus are substantially parallel to each other. At least one polarizer (not shown) polarizing light is attached to an outer side of the liquid crystal panel assembly 400.

The data processing apparatus 500 selectively applies a single gamma, a double gamma, and a quadruple gamma to images signals R, G, and B input from an external apparatus to generate compensated image signals R', G', and B'. The image signals R, G, and B contain luminance information on the plurality of pixels. Luminance has the predetermined number of gray levels, for example, $1024=2^{10}$, $=2^{8}$ or $64=2^{6}$ gray levels. The data processing apparatus 500 selects a portion having low side visibility and applies multi gamma to the portion having low side visibility to generate the compensated image signals R', G', and B', thereby improving the side visibility.

The signal controller 100 receives the compensated image signals R', G', and B' from the data processing apparatus 500 and signals from the external apparatus. The signals includes a data enable signal DE, a horizontal synchronization signal Hsync, a vertical synchronization signal Vsync, and a main clock signal MCLK.

The signal controller 100 generates a first driving control signal CONT1, a second driving control signal CONT2, and image data DAT according to the compensated image signals R', G', and B', the data enable signal DE, the horizontal synchronization signal Hsync, the vertical synchronization signal Vsync, and the main clock signal MCLK. The signal controller 100 distinguishes the compensated image signals R', G', and B' in the unit of frames according to the vertical synchronization signal Vsync and distinguishes the compensated image signals R', G', and B' in the unit of scan lines according to the horizontal synchronization signal Hsync to generate the image data DAT. The signal controller 100 transmits the first driving control signal CONT1 to the scan driver 200. The signal controller 100 transmits the image data signal DAT to the data driver 300 together with the second driving control signal CONT2.

The scan driver 200 is connected to the plurality of scan lines S1 to Sn and generates a plurality of scan signals according to the first driving control signal CONT1. The scan driver 200 may sequentially apply scan signals of a gate-on voltage to the plurality of scan lines S1 to Sn.

The data driver 300 is connected to the plurality of data lines D1 to Dm, samples and holds the image data DAT input according to the second driving control signal CONT2, and transmits a plurality of data signals to the plurality of data lines D1 to Dm. The data driver 300 applies data signals having a predetermined voltage range to the plurality of data lines D1 to Dm corresponding to the scan signals of the gate-on voltage.

Each of the driving apparatuses 100, 200, 300, and 500 may be directly mounted on the liquid crystal panel assembly 400 in at least one IC chip form, mounted on a flexible printed circuit film, attached to the liquid crystal panel assembly 400 in a tape carrier package (TCP) form, or mounted on a separate printed circuit board. Alternatively, the driving apparatuses 100, 200, 300, and 500 may be integrated into the liquid crystal panel assembly 400 together with the plurality of scan lines S1 to Sn and the plurality of data lines D1 to Dm.

Hereinafter, the data processing apparatus 500 that selects a portion having low side visibility and applies a multi gamma to generate compensated image signals R', G', and B' will be described.

Figure 2:
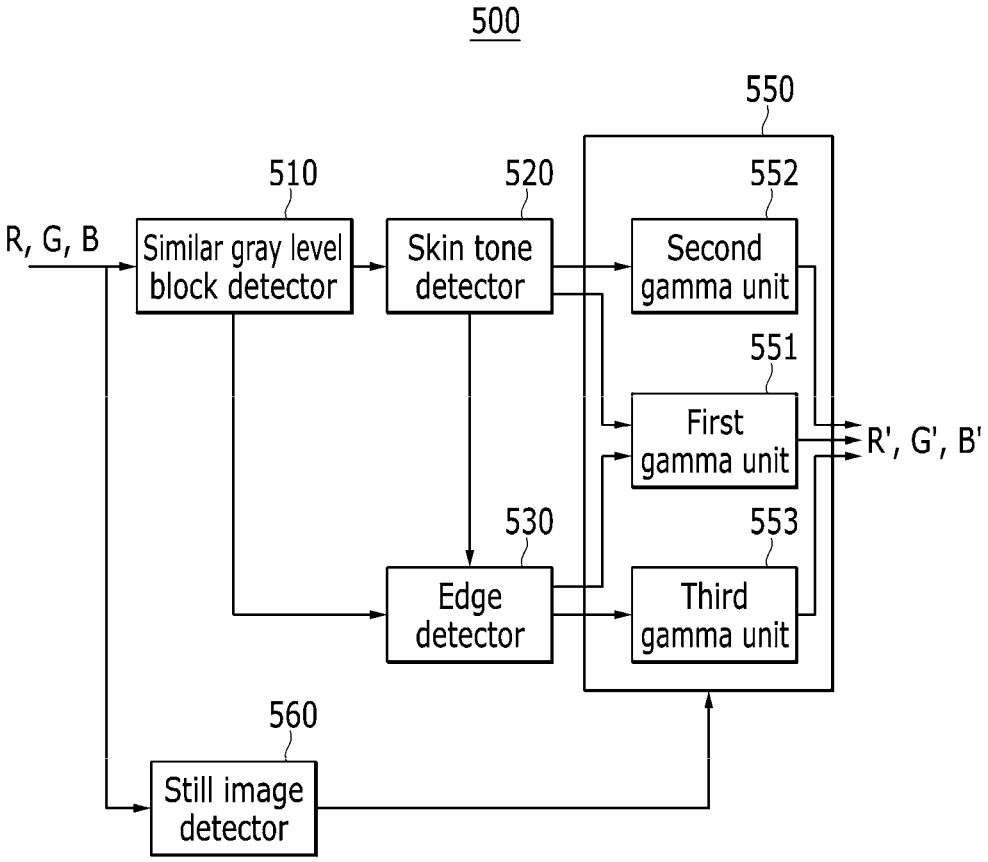
FIG. 2 is a block diagram illustrating a data processing apparatus according to an exemplary embodiment of the inventive concept.

FIG. 2 is a block diagram illustrating a data processing apparatus according to an exemplary embodiment of the inventive concept.

Referring to FIG. 2, the data processing apparatus 500 includes a similar gray level block detector 510, a skin tone detector 520, an edge detector 530, a gamma processor 550, and a still image detector 560. The gamma processor 550 includes a first gamma unit 551, a second gamma unit 552, and a third gamma unit 553.

The similar gray level block detector 510 receives the image signals R, G, and B and detects a pixel data block having similar gray level values using the image signals R, G, and B. The similar gray level detector 510 may detect a pixel data block having similar gray level values by selecting an N×N pixel data block from the image signals R, G, and B of one frame and determining whether gray level differences among a plurality of pixel data in the pixel data block is equal to or smaller than a predetermined threshold. Alternatively, the similar gray level block detector 510 may detect a pixel data block having similar gray level values by calculating an average gray level value of pixel data included in the N×N pixel data block and determining whether a difference between a gray level value of each pixel data and the average gray level value is equal to or smaller than a predetermined threshold. The gray level value of each pixel data is include in the image signals R, G and B.

A size of the pixel data block may be variously determined as necessary. For example, a 8×8 pixel data block, a 4×4 pixel data block or the like may be selected.

Figure 3:
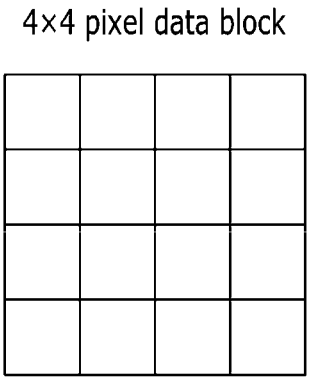
FIG. 3 is a diagram illustrating a method of selecting a pixel data block in a data processing apparatus according to an exemplary embodiment of the inventive concept.

Referring to FIG. 3, an example of selecting the 4×4 pixel data block will be described. FIG. 3 is a diagram illustrating a method of selecting a pixel data block in a data processing apparatus according to an exemplary embodiment of the inventive concept.

Referring to FIG. 3, the 4×4 pixel data block is selected from the image signals R, G, and B of one frame. 16 pixel data is included in the 4×4 pixel data block. Each pixel data includes red, green, and blue subpixel data. That is, the pixel data includes red subpixel data, green subpixel data, and blue subpixel data. The pixel data may include more than three subpixel data. The number of subpixel data in the pixel data depends on the number of primary colors used to display an image.

The similar gray level block detector 510 determines whether a difference between gray level values of the red subpixel data of the 16 pixel data is equal to or smaller than a predetermined threshold, whether a difference between gray level values of the green subpixel data of the 16 pixel data is equal to or smaller than a predetermined threshold, and whether a difference between gray level values of the blue subpixel data of the 16 pixel data is equal to or smaller than a predetermined threshold. When all of the difference between the gray level values of the red subpixel data, the difference between the gray level values of the green subpixel data, and the difference of the gray level values of the blue subpixel data are equal to or smaller than the predetermined threshold, the similar gray level block detector 510 detects the 4×4 pixel data block as a pixel data block having a similar gray level value. A plurality of pixel data included in the pixel data block, which is determined as a pixel data block having a similar gray level value, has pixel data displaying similar colors. Referring back to FIG. 2, the similar gray level block detector 510 transmits informations on the pixel data block having the similar gray level values to the skin tone detector 520. The similar gray level block detector 510 transmits informations on a pixel data block which does not have the similar gray level values, that is, informations on a pixel data block in which a difference between gray level values of the pixel data exceeds the threshold, to the edge detector 530. The similar gray level block detector 510 may transmit informations on the pixel data block which does not have the similar gray level values to the skin tone detector 520 in order to determine whether an edge portion detected by the edge detector 530 has a skin tone.

The skin tone detector 520 detects a pixel having a skin tone in the pixel data block. Usually, a viewer more focuses on a person or animal than a background in an image. A skin tone of the person or animal has lower side visibility in comparison with other colors. The skin tone detector 520 detects a skin tone having low side visibility. The skin tone refers to a color having the low side visibility. Particularly, the skin tone may refer to a skin tone of the person or animal.

The skin tone detector 520 may detect a pixel having a skin tone by comparing gray level values of red, green, and blue colors of the pixel data included in the pixel data block. For example, when a red gray level value of the pixel data is larger than a green gray level value and the red gray level value is larger than a blue gray level value, the skin tone detector 520 may detect that the corresponding pixel data includes the skin tone. Alternatively, the skin tone detector 520 may multiply the green gray level value and the blue gray level value by a predetermined correction parameter respectively and compare them with the red gray level value. The correction parameter may be experimentally determined.

In another method of detecting a skin tone, the skin tone detector 520 may use a color histogram of each pixel data. In general, the color histogram shows distributions of gray levels of the red, green, and blue colors. The skin tone detector 520 has a color distribution range indicating a skin tone in the color histogram and may detect the skin tone according to whether each color histogram of the pixel data is included in the color distribution range. The color distribution range indicating the skin tone may be experimentally determined. The skin tone detector 520 may detect a pixel data finally indicating the skin tone by passing the pixel data of which the color histogram is included in the color distribution range through a low pass filter.

If the pixel data block is a pixel data block having similar gray level values and one pixel data included in the pixel data block includes a skin tone, it may be considered that all pixel data included in the pixel data block includes the skin tone.

If the pixel data block is a pixel data block which does not have similar gray level values, the skin tone detector 520 may detect each of the skin tones of the pixel data included in the pixel data block and transmit information on the pixel data to the edge detector 530.

The skin tone detector 520 transmits information on the pixel data block which does not include the skin tone to the first gamma unit 551 and transmits information on the pixel data block indicating the skin tone to the second gamma unit 552.

The edge detector 530 detects an edge of an object having the skin tone from the pixel data block. The pixel data block which does not have the similar gray level value may not include the skin tone, but may include a boundary between an object having the skin tone and another object. That is, the edge detector 530 detects a boundary between an object having the skin tone and another object. That is, the edge detector 520 may receive information on the pixel data including the skin tone from the skin tone detector 520, and perform a process of detecting the object only when the pixel data including the skin tone is included in the pixel data block.

The edge detector 530 may detect an edge of the object having the skin tone by using an edge detection filter. The edge detector 530 may detect the edge of the object having the skin tone by using an N×N edge detection filter corresponding to an N×N pixel data block. Alternatively, the edge detector 530 may detect the edge having the skin tone by using an n×n edge detection filter having a size smaller than the N×N pixel data block.

For example, an 8×8 edge detection filter may be used for an 8×8 pixel data block or a 4×4 edge detection filter may be used for the 8×8 pixel data block. Alternatively, a 3×3 pixel data block is selected from the 4×4 pixel data block, and then a 3×3 edge detection filter may be used for the selected 3×3 pixel data block.

An example of using the 3×3 edge detection filter for the 3×3 pixel data block will be described with reference to FIGS. 4 and 5.

Figure 4:
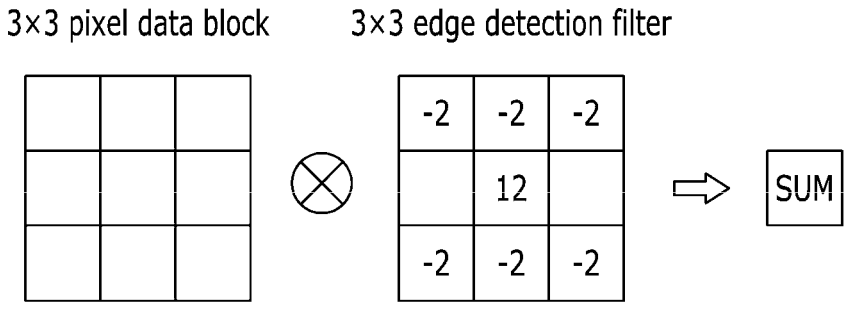
FIG. 4 is a diagram illustrating a method of detecting an edge of a portion having low side visibility in a data processing apparatus according to an exemplary embodiment of the inventive concept.
Figure 5:
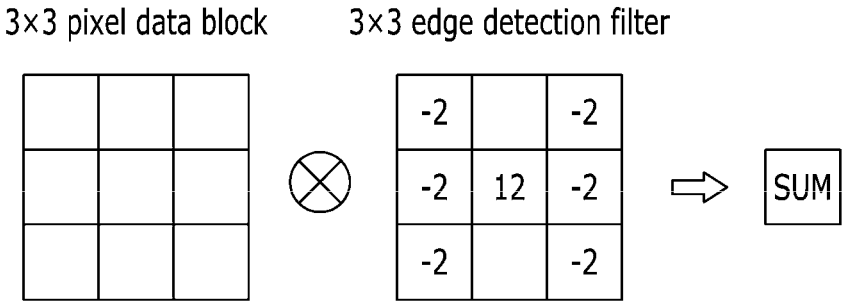
FIG. 5 is a diagram illustrating a method of detecting an edge of a portion having low side visibility in a data processing apparatus according to an exemplary embodiment of the inventive concept.

FIGS. 4 and 5 are block diagrams illustrating a method of detecting an edge of a portion having low side visibility in a data processing apparatus according to an exemplary embodiment of the inventive concept.

Referring to FIG. 4, the 3×3 pixel data block is multiplied by the 3×3 edge detection filter. The 3×3 edge detection filter includes a positive scale coefficient and a negative scale coefficient. The positive scale coefficient is 12 and the negative scale coefficient is −2.

The positive scale coefficient is located at the second row and second column corresponding to a center of the 3×3 edge detection filter. The negative scale coefficients are located at the first row and the third row of the 3×3 edge detection filter. An overall sum of the positive scale coefficient and the negative scale coefficients is 0.

A sum of the pixel data is calculated after multiplying scale coefficients corresponding to the pixel data included in the 3×3 pixel data block. In general, a gray level value of the object having the skin tone is larger than gray level values of other objects. When the edge of the object having the skin tone is located at the first row or third row of the 3×3 pixel data block, the sum of the pixel data multiplied by the scale coefficient has a negative value. When the sum of the pixel data is smaller than a predetermined negative threshold, it may be determined that the corresponding pixel data block includes edges in a row direction.

Referring to FIG. 5, unlike FIG. 4, the negative scale coefficients are located at the first column and the third column of the 3×3 edge detection filter in a column direction. When an edge of the object having the skin tone is located at the first column or third column of the 3×3 pixel data block, a sum of the pixel data multiplied by the scale coefficient has a negative value. When the sum of the pixel data has a value smaller than a predetermined negative threshold, it may be determined that the corresponding pixel data block includes the edges in the column direction.

Four 3×3 pixel data blocks may be extracted from the 4×4 pixel data block, and the edge of the object having the skin tone may be detected by applying the 3×3 edge detection filter to each of the four 3×3 pixel data blocks. That is, four edge detection processes may be performed for one 4×4 pixel data block, thereby increasing accuracy of the edge detection.

FIGS. 4 and 5 are only one example of the edge detection filter, and do not limit a size of the edge detection filter and the scale coefficient included in the edge detection filter. The size of the edge detection filter and the scale coefficient included in the edge detection filter may be variously determined. That is, the edge detector 530 may detect the edge of the object having the skin tone by using various types of edge detection filters.

Referring back to FIG. 2, the edge detector 530 transmits information on the pixel data block including the edge of the object having the skin tone to the third gamma unit 553 and transmits information on the pixel data block which does not include the edge of the object having the skin tone to the first gamma unit 551.

The first gamma unit 551 applies a single gamma or a time division double gamma to the pixel data block. The single gamma may be 2.2 which is a reference gamma. The time division double gamma includes a first gamma applied to odd frames and a second gamma applied to even frames. The first gamma and the second gamma have different gamma values. A product of the first gamma and the second gamma may be 2.2 which is the reference gamma. Information on a pixel data block input into the first gamma unit 551 is information on the pixel data block which does not include the skin tone among the pixel data blocks having the similar gray level value and information on a pixel data block which does not include the edge of the object having the skin tone among the pixel data blocks which do not have the similar gray level values. The single gamma is applied to the pixel data block which does not have the skin tone in the image.

The second gamma unit 552 applies a multi gamma to the pixel data block. The multi gamma includes a space division multi gamma and a time division multi gamma. For example, the multi gamma may include a space division double gamma, a space division quadruple gamma, a space and time division double gamma, and a space and time division quadruple gamma. Information on a pixel data block input into the second gamma unit 552 is the information on the pixel data block including the skin tone and having the similar gray level values throughout the pixel data block. The multi gamma is applied to the pixel data block of the skin tone in the image The third gamma unit 553 applies the single gamma or the multi gamma to the pixel data block. Information on a pixel data block input into the third gamma unit 553 is the information on the pixel data block including the edge of the object having the skin tone and having different gray level values in the pixel data block. The single gamma or the multi gamma is applied to the edge of the skin tone.

The first gamma unit 551, the second gamma unit 552 and the third gamma unit may be included in a gamma unit.

The still image detector 560 receives image signals R, G, and B and compares an image of a previous frame and an image of a current frame based on the image signals R, G, and B so as to detect whether the current image is a still image or a moving image. When image signals R, G, and B of the previous frame are the same as image signals R, G, and B of the current frame, the image of the current frame is determined as the still image. When the image signals R, G, and B of the previous frame are different from the image signals R, G, and B of the current frame, the image of the current frame is determined as the moving image.

The still image detector 560 transmits still image information and moving image information to the gamma processor 550. The gamma processor 550 may apply the time division multi gamma when the still image information is received, and apply the space division multi gamma when the moving image information is received.

That is, when the still image information is received, the first gamma unit 551 may apply the single gamma or time division double gamma, the second gamma unit 552 may apply the time division multi gamma, and the third gamma unit 553 may apply the single gamma or time division multi gamma.

When the moving image information is received, the first gamma unit 551 may apply the single gamma, the second gamma unit 552 may apply the space division multi gamma, and third gamma unit 553 may apply the single gamma or space division multi gamma.

If the space division gamma is applied to the still image, viewers may perceive that a resolution is lowered especially when a viewing distance is very close to the display. However, by applying the time division multi gamma, the side visibility can be improved without deteriorating the resolution.

If the time division gamma is applied to the moving image, the visibility may be lowered due to slow response time of the liquid crystal. By applying the space division multi gamma, the visibility deterioration due to the slow response time of the liquid crystal can be improved.

Information on the pixel data block to which the single gamma or the multi gamma is applied by the gamma processor 550 is output as compensated image signals R', G', and B'.

Hereinafter, an example in which the single gamma and the multi gamma are applied to the pixel data block will be described with reference to FIGS. 6 to 11. Hereinafter, reference numerals a, b, c, and d indicating the gammas are to distinguish between different gammas. The same reference numbers in a same exemplary embodiment may refer to the same gamma value and the same reference numbers in a different exemplary embodiment may not refer to the same gamma value.

Figure 6:
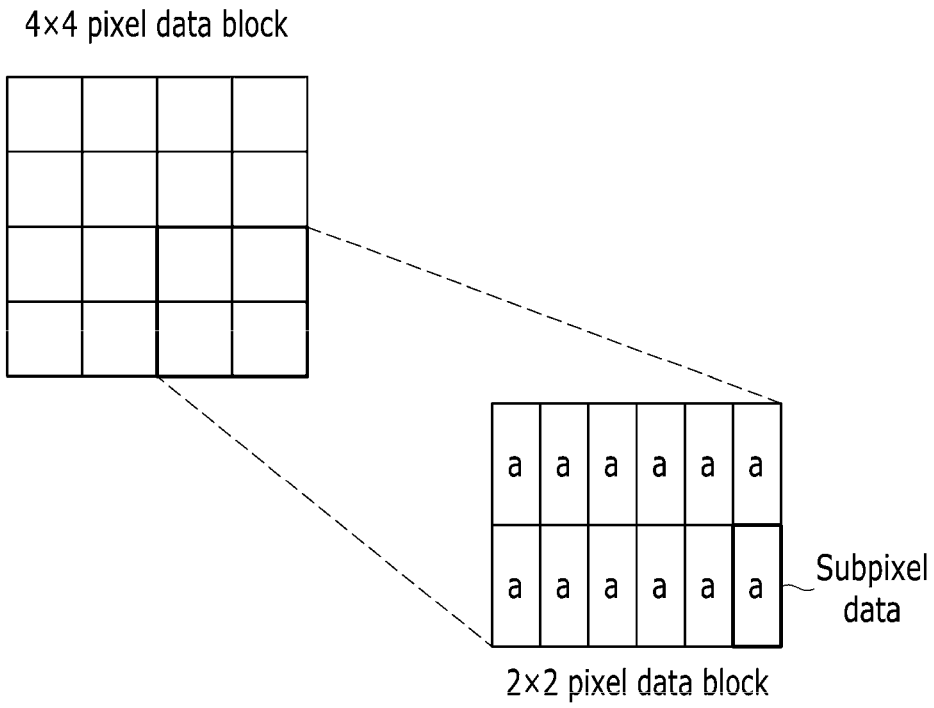
FIG. 6 is a diagram illustrating a method of applying a single gamma according to an exemplary embodiment of the inventive concept.

FIG. 6 is a diagram illustrating a method of applying the single gamma according to an exemplary embodiment of the inventive concept.

Referring to FIG. 6, a case where a single gamma a is applied to all pixel data included in the 4×4 pixel data block is illustrated. The single gamma a is applied to each of a red subpixel data, a green subpixel data, and a blue subpixel data included in the each pixel data. The single gamma a may be 2.2 which is the reference gamma.

Figure 7:
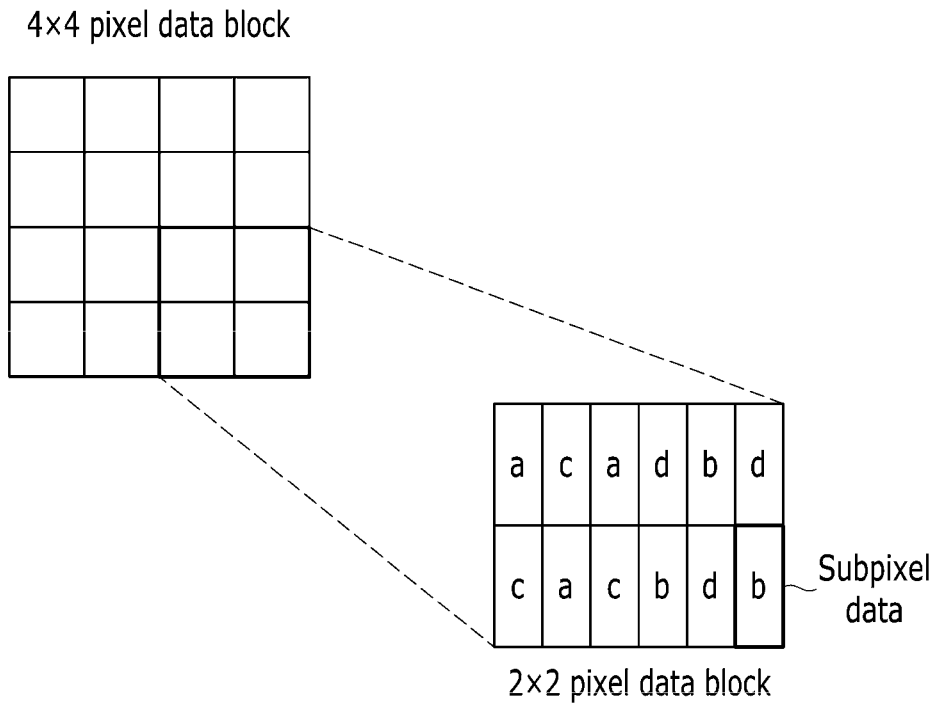
FIG. 7 is a diagram illustrating a method of applying a space division quadruple gamma according to an exemplary embodiment of the inventive concept.

FIG. 7 is a diagram illustrating a method of applying the space division quadruple gamma according to an exemplary embodiment of the inventive concept.

Referring to FIG. 7, when a plurality of pixel data included in the 4×4 pixel data block is divided into 2×2 pixel data blocks, four pixel data is included in the 2×2 pixel data blocks. Each of the four pixel data includes the red subpixel data, the green subpixel data, and the blue subpixel data. In the 2×2 pixel data block, a first gamma a and a third gamma c are applied to the pixel data in a first column, and a second gamma b and a fourth gamma d are applied to the pixel data in a second column.

In this case, each of the first to fourth gammas a, b, c, and d is applied to the corresponding subpixel data respectively. The first gamma a is applied to subpixel data adjacent to the subpixel data to which the third gamma c is applied, and the third gamma c is applied to subpixel data adjacent to the subpixel data to which the first gamma a is applied. The second gamma b is applied to subpixel data adjacent to the subpixel data to which the fourth gamma d is applied, and the fourth gamma d is applied to subpixel data adjacent to the subpixel data to which the second gamma b is applied.

The first to fourth gammas a, b, c, and d have different gamma values, and a product of the first to fourth gammas may be 2.2 which is the reference gamma. For example, the first gamma may be 0.275, the second gamma may be 1, the third gamma may be 2, and the fourth gamma may be 4. Values of the first to fourth gammas a, b, c, and d may be variously determined within a range in which the product of the first to fourth gammas is 2.2 which is the reference gamma.

In such a way, the first to fourth gammas a, b, c, and d are applied to each of the subpixel data at every frame.

Figure 8:
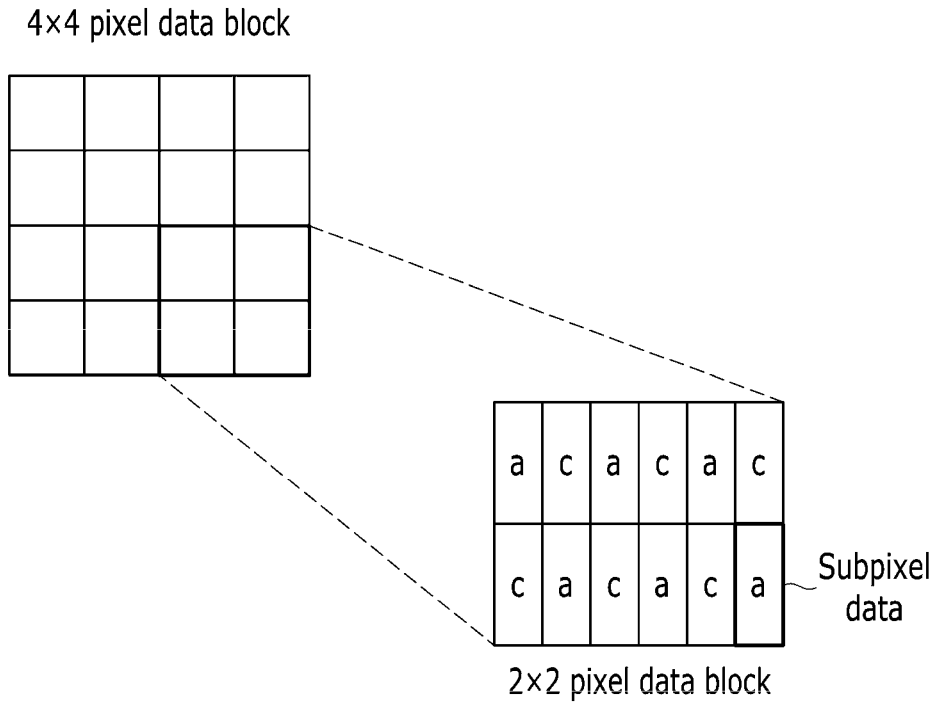
FIG. 8 is a diagram illustrating a method of applying a space division double gamma according to an exemplary embodiment of the inventive concept.

FIG. 8 is a diagram illustrating a method of applying the space division double gamma according to an exemplary embodiment of the inventive concept.

Referring to FIG. 8, when a plurality of pixel data included in the 4×4 pixel data block is divided into 2×2 pixel data blocks, a first gamma a and a third gamma c are applied to the 2×2 pixel data blocks.

In this case, each of the first gamma a and the third gamma c is applied to the corresponding subpixel data respectively. The first gamma a is applied to subpixel data adjacent to the subpixel data to which the third gamma c is applied, and the third gamma c is applied to subpixel data adjacent to the subpixel to which the first gamma a is applied.

The first gamma a and the third gamma c have different gamma values, and a product of the first gamma a and the third gamma c may be 2.2 which is the reference gamma. For example, the first gamma may be 0.55, and the third gamma may be 4. Values of the first gamma a and the third gamma c may be variously determined within a range in which the product of the first gamma and the third gamma is 2.2 which is the reference gamma.

In such a way, the first gamma a and the third gamma c are applied to each of the subpixel data at every frame.

Figure 9:
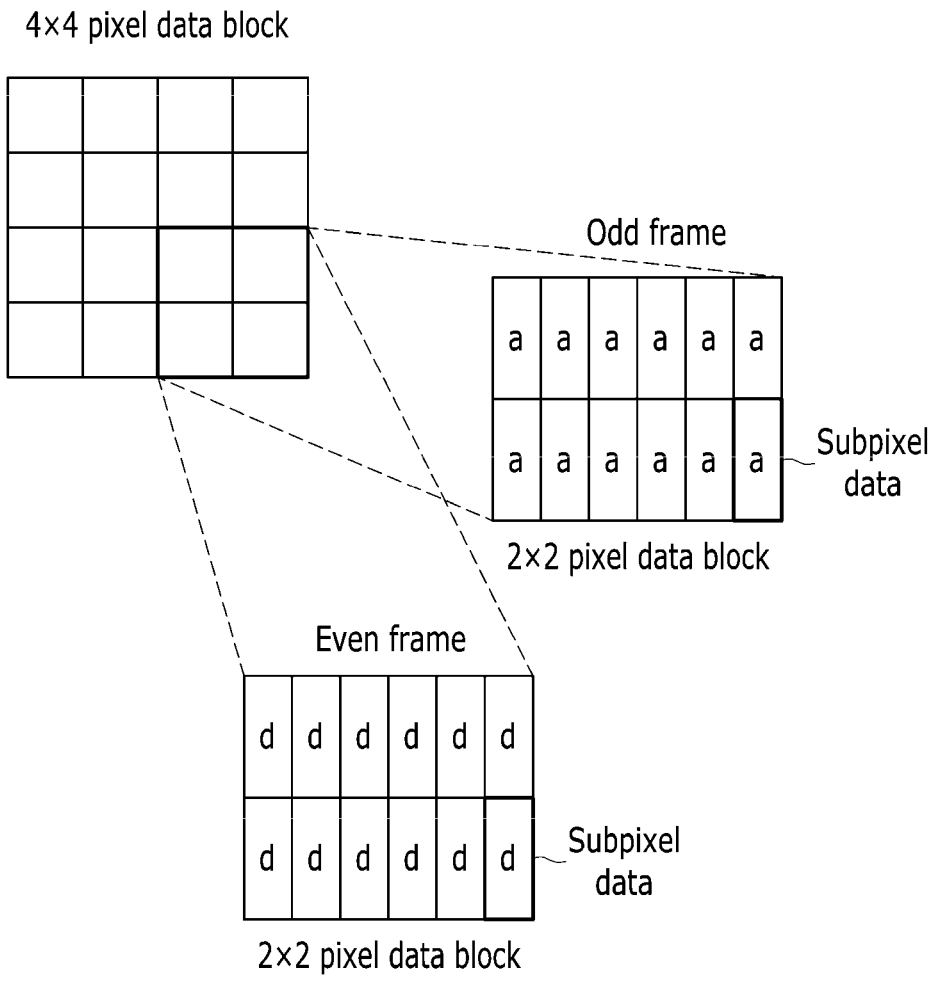
FIG. 9 is a diagram illustrating a method of applying a time division double gamma according to an exemplary embodiment of the inventive concept.

FIG. 9 is a block diagram illustrating a method of applying the time division double gamma according to an exemplary embodiment of the inventive concept.

Referring to FIG. 9, all pixels included in the 4×4 pixel data block are applied with same gamma during the same frame. For example, a first gamma a is applied to all pixels included in the 4×4 pixel data block during odd frames and a fourth gamma d is applied to all pixels included in the 4×4 pixel data block during even frames. That is, the first gamma a is applied to each of a red subpixel data, a green subpixel data, and a blue subpixel data included in the 4×4 pixel data block during the odd frames, and the fourth gamma d is applied to each of a red subpixel data, a green subpixel data, and a blue subpixel data included in the 4×4 pixel data block during the even frames.

The first gamma a and the fourth gamma d have different gamma values, and a product of the first gamma and the fourth gamma may be 2.2 which is the reference gamma. For example, the first gamma may be 0.55 and the fourth gamma may be 4. Values of the first gamma a and the fourth gamma d may be variously determined within a range in which the product of the first gamma and the fourth gamma is 2.2 which is the reference gamma.

As described above, different gammas are applied to each of the subpixel data between the adjacent frames. That is, different gammas are applied to each of the subpixel data alternately.

Figure 10:
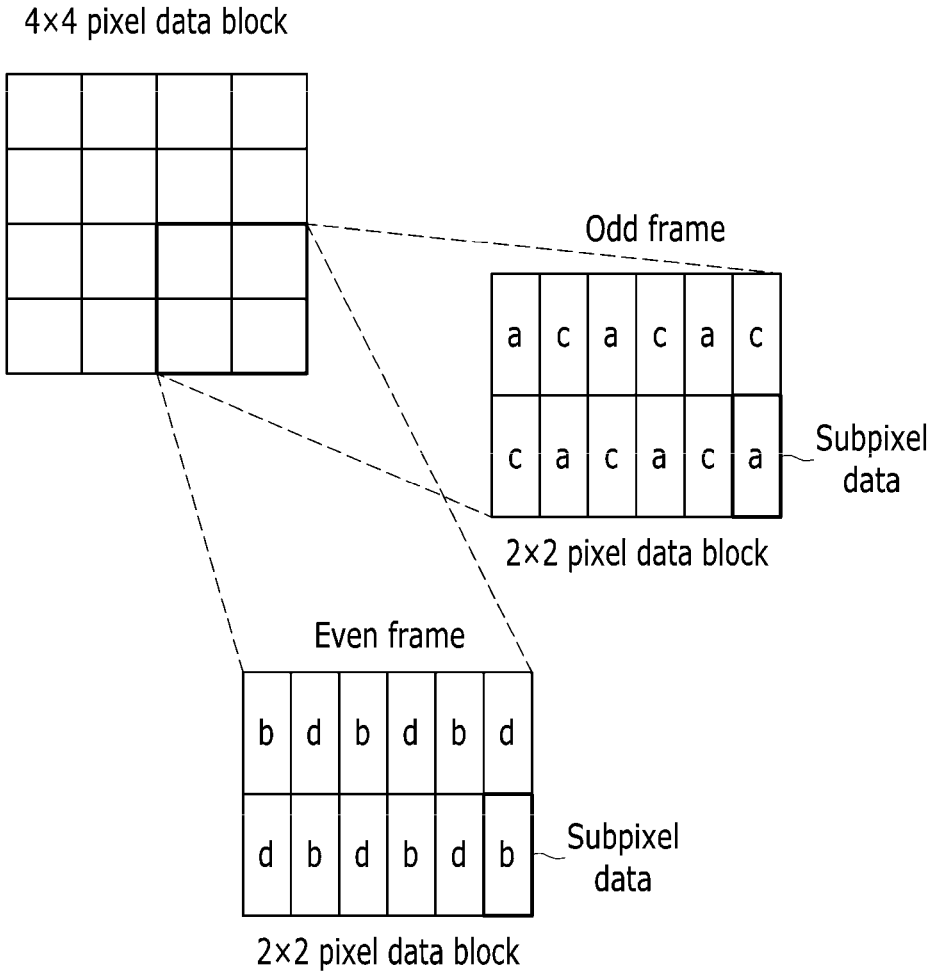
FIG. 10 is a diagram illustrating a method of applying a space and time division quadruple gamma according to an exemplary embodiment of the inventive concept.

FIG. 10 is a block diagram illustrating a method of applying the space and time division quadruple gamma according to an exemplary embodiment of the inventive concept.

Referring to FIG. 10, when a plurality of pixel data included in the 4×4 pixel data block is divided into 2×2 pixel data blocks, a first gamma a and a third gamma c are applied to the 2×2 pixel data blocks during odd frames and a second gamma b and a fourth gamma d are applied to the 2×2 pixel data blocks during even frames. That is, the first gamma a and the third gamma c are applied to the pixel dataduting the odd frames and the second gamma b and the fourth gamma d are applied to the pixel data during the even frames.

In this case, the first gamma a is applied to subpixel data adjacent to the subpixel data to which the third gamma c is applied, and the third gamma c is applied to subpixel data adjacent to the subpixel data to which the first gamma a is applied. The second gamma b is applied to subpixel data adjacent to the subpixel data to which the fourth gamma d is applied, and the fourth gamma d is applied to subpixel data adjacent to the subpixel data to which the second gamma b is applied.

The first to fourth gammas a, b, c, and d have different gamma values, and a product of the first to fourth gammas may be 2.2 which is the reference gamma. Values of the first to fourth gammas a, b, c, and d may be variously determined within a range in which the product of the first to fourth gammas is 2.2 which is the reference gamma.

Table 1 shows a combination of the single gamma and the multi gamma applicable by the first gamma unit 551, the second gamma unit 552, and the third gamma unit 553.

TABLE 1

| Combination | First gamma unit (portions other than skin tone) | Second gamma unit (skin tone portion) | Third gamma unit (skin tone edge portion) |
|---|---|---|---|
| 1 | As(3, 4) | Bs(1, 2) | As or Bs |
| 2 | A(3) | Bs(1, 2) | A or Bs |
| 3 | A(4) | Bs(1, 2, 3, 4) | A or Bs or Cs(1, 3) |
| 4 | Ast(1, 4) | Bst(1, 2, 3, 4) | Ast or Bst |
| 5 | Ast(2, 3) | Bst(1, 4) | Ast or Bst |
| 6 | A(2) | Bst(1, 4) | A or Bst |
| 7 | A(1) | Bst(1, 2, 3, 4) | A or Bst or Cst(1, 3) |

In Table 1, A denotes a single gamma, As, Bs, and Cs denote a space division gamma, and Ast and Bst denote a space and time division gamma. As(3,4) and Bs(1,2) mean applying the space division gamma by using two gammas. In this case, As(3,4) and Bs(1,2) mean applying different gammas. Bs(1,2,3,4) means applying the space division gamma by using four gammas. Ast(1,4) means applying the space and time division gamma by using two gammas. Bst(1,2,3,4) means applying the space and time division gamma by using four gammas. Ast(2,3) and Bst(1,4) mean applying the space and time division gamma by sing two gammas, and the gammas used in Ast(2,3) and the gammas in Bst(1,4) are different from each other.

As described, in applying the single gamma and the multi gamma, the space division and time division gammas may be applied in various ways. Although not described in the above example, another combination can be apparently derived from the above described combinations.

Figure 11:
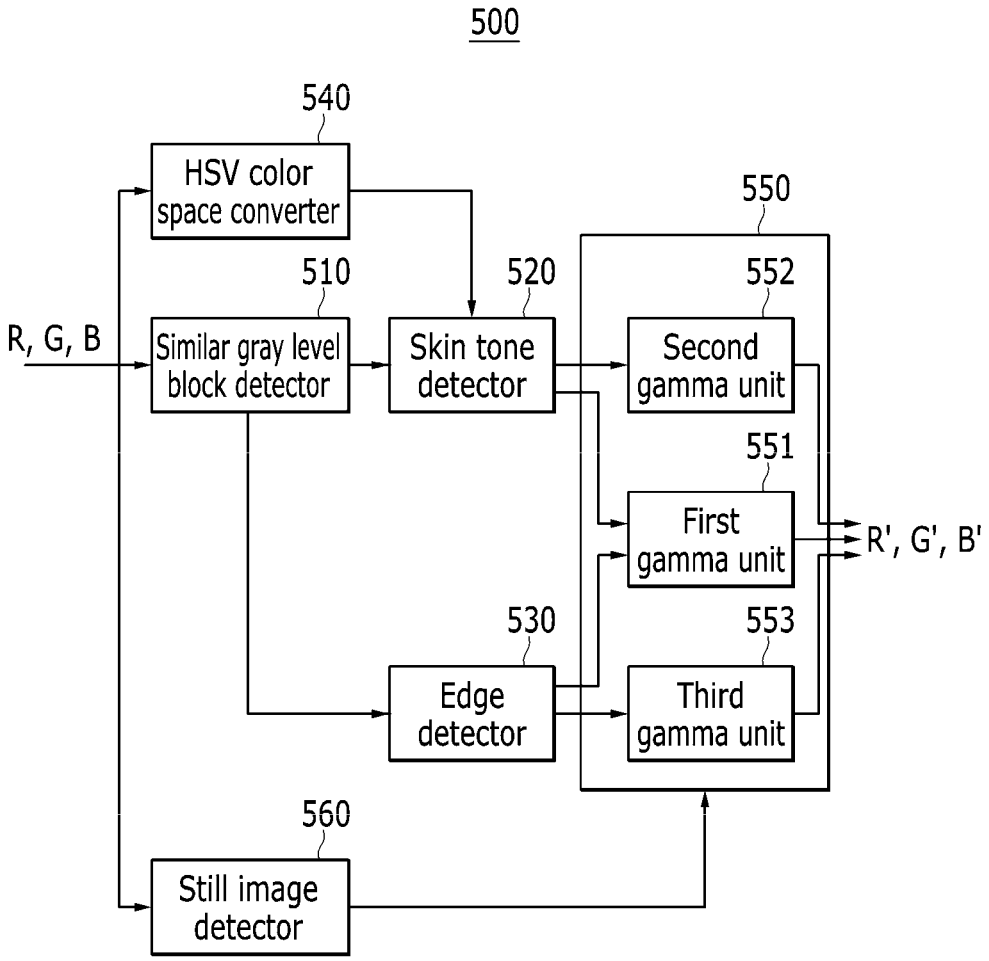
FIG. 11 is a diagram illustrating a data processing apparatus according to another exemplary embodiment of the inventive concept.

FIG. 11 is a block diagram illustrating a data processing apparatus according to another exemplary embodiment of the inventive concept.

Compared to FIG. 2, the data processing apparatus 500 further includes an HSV color space converter 540.

The HSV color space converter 540 receives image signals R, G, and B and converts the image signals R, G, and B to HSV data. The HSV data is data representing a color with hue, saturation, and value (brightness). The image signals R, G, and B are RGB data representing gray levels of red, green, and blue. A method of converting the RGB data to the HSV data may use a well known transformation matrix. A detailed description thereof will be omitted.

The HSV color space converter 540 transmits the HSV data to the skin tone detector 520.

The skin tone detector 520 detects whether hue and saturation are within a predetermined skin tone range in the HSV data. That is, the skin tone detector 520 detects whether j<Hue<k, l<Saturation<m in the HSV data. Here, j, k, l, and m denote skin tone range parameters to detect the skin tone and may be experimentally determined.

When the hue and the saturation are within the predetermined skin tone range in the HSV data, the skin tone detector 520 may determine that pixel data corresponding to the HSV data includes the skin tone. Alternatively, when the hue and the saturation are within the predetermined skin tone range in the HSV data, a red gray level of the pixel data corresponding to the HSV data is larger than a green gray level, and the red gray level is larger than a blue gray level, the skin tone detector 520 may detect that the corresponding pixel data includes the skin tone.

Since the other components are the same as those described through FIG. 2, detailed descriptions thereof will be omitted.

Hereinafter, a result of an experiment of measuring an effect in which side visibility is improved when the single gamma, the space division double gamma, and the space division quadruple gamma are applied will be described with reference to FIGS. 12 to 17. By using image signals R, G, and B of 64 gray levels, a relation between a gray level and a liquid crystal driving voltage, and front luminance and side luminance according to the gray level are measured.

Figure 12:
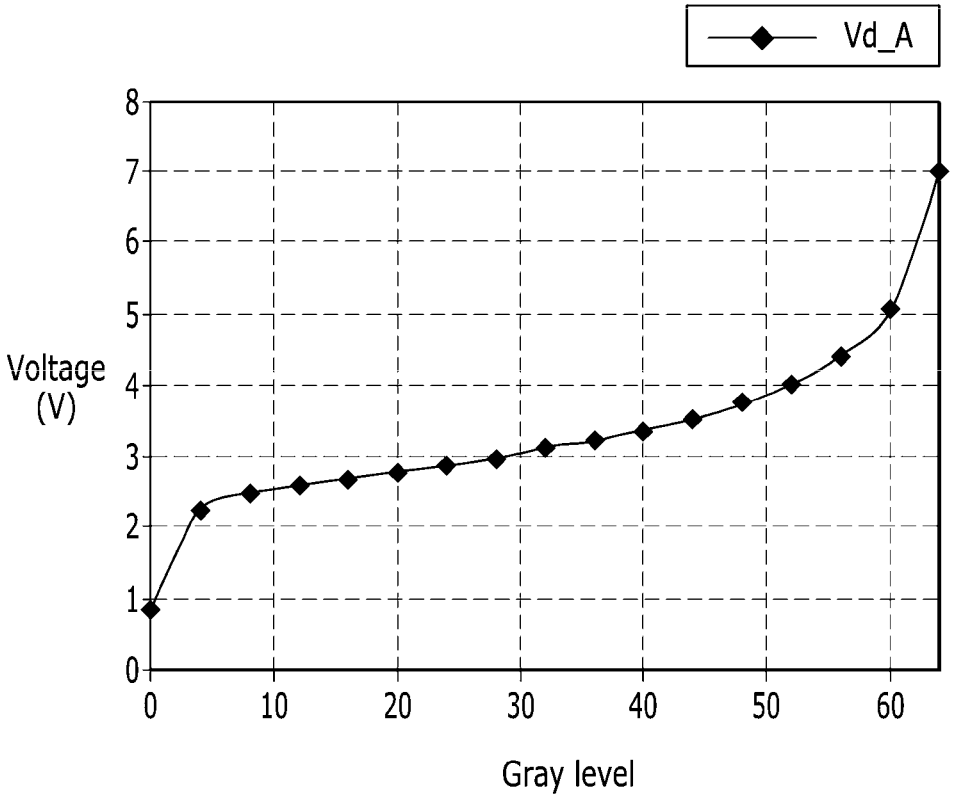
FIG. 12 is a graph showing a result of experimenting on a relation between a gray level and a liquid crystal driving voltage by applying a single gamma.
Figure 13:
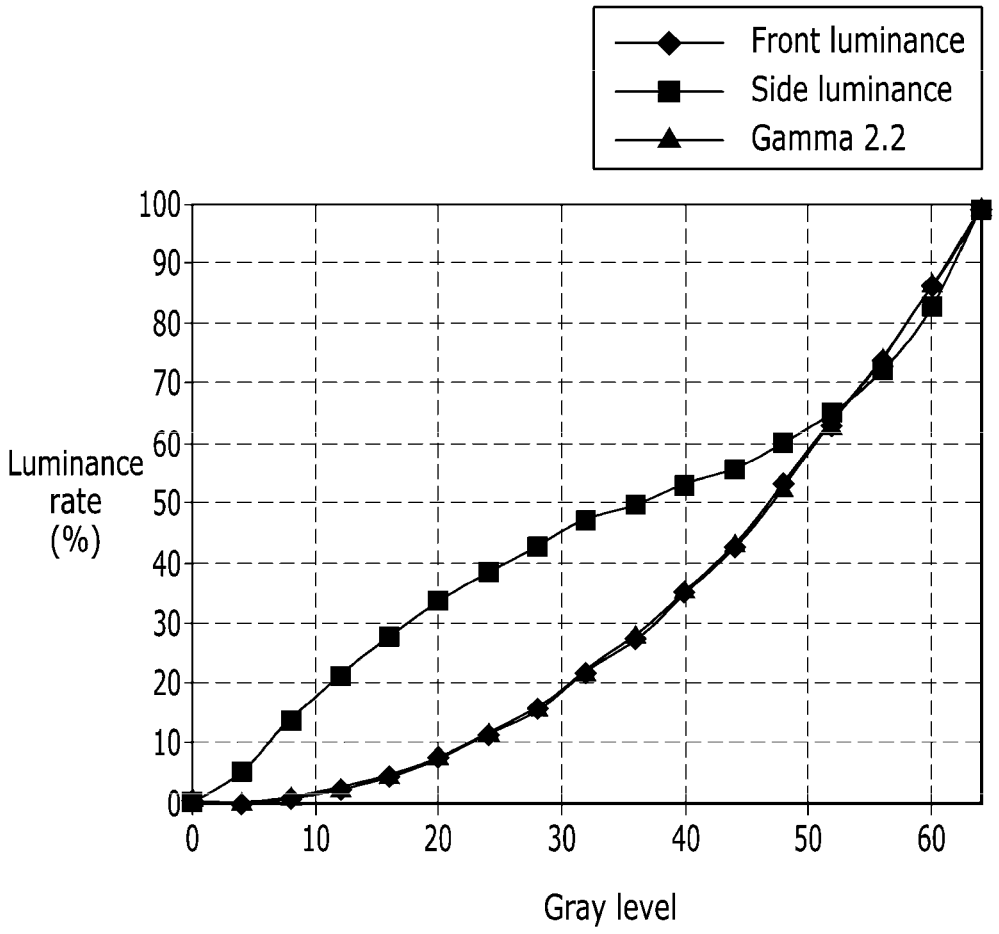
FIG. 13 is a graph showing a result of experimenting on front luminance and side luminance according to a gray level by applying a single gamma.

FIG. 12 is a graph showing a result of experimenting on the relation between the gray level and the liquid crystal driving voltage by using the single gamma. FIG. 13 is a graph showing a result of measuring front luminance and side luminance according to the gray level by using the single gamma.

Referring to FIGS. 12 and 13, a single gamma Vd_A is 2.2 which is the reference gamma. It is noted that the gray level increases as the liquid crystal driving voltage increases.

If the single gamma Vd_A is applied, as the gray level increases, the front luminance increases substantially the same rate as a luminance rate according to the reference gamma 2.2 increases. In contrast, the side luminance is higher than the luminance according to the reference gamma 2.2 in low gray levels. That is, there is a difference between the side luminance and the front luminance. A difference in the luminance rates of the side luminance and the front luminance is 39.2%.

Figure 14:
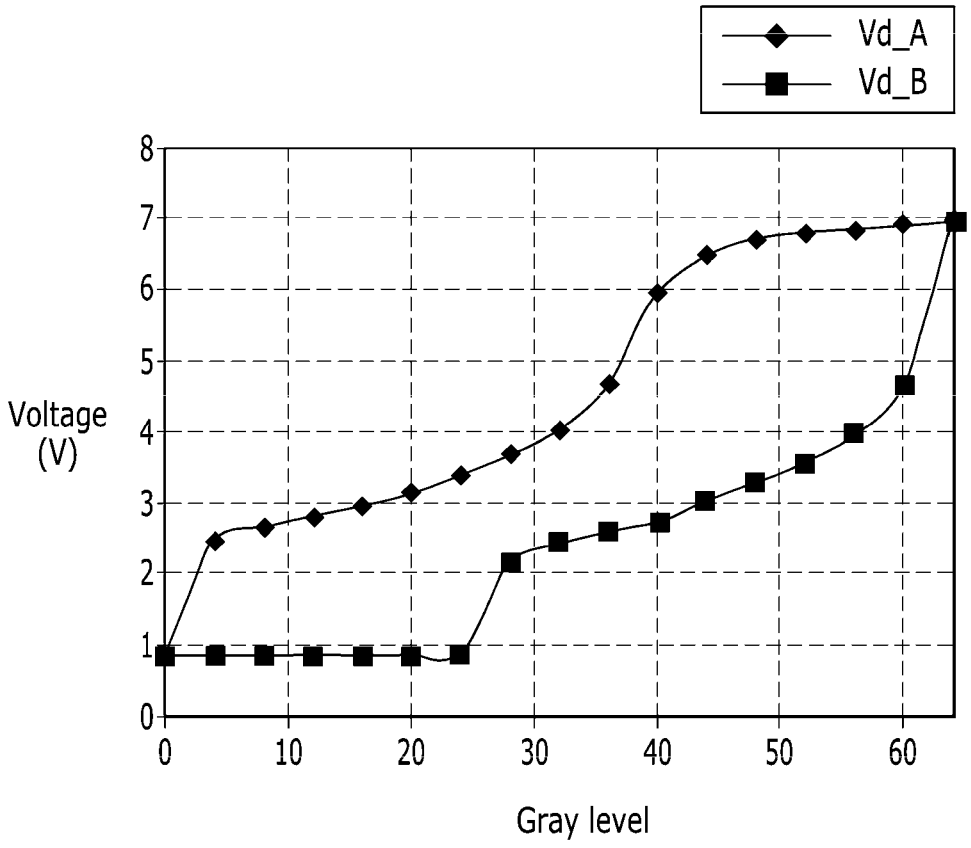
FIG. 14 is a graph showing a result of experimenting on a relation between a gray level and a liquid crystal driving voltage by applying a space division double gamma.
Figure 15:
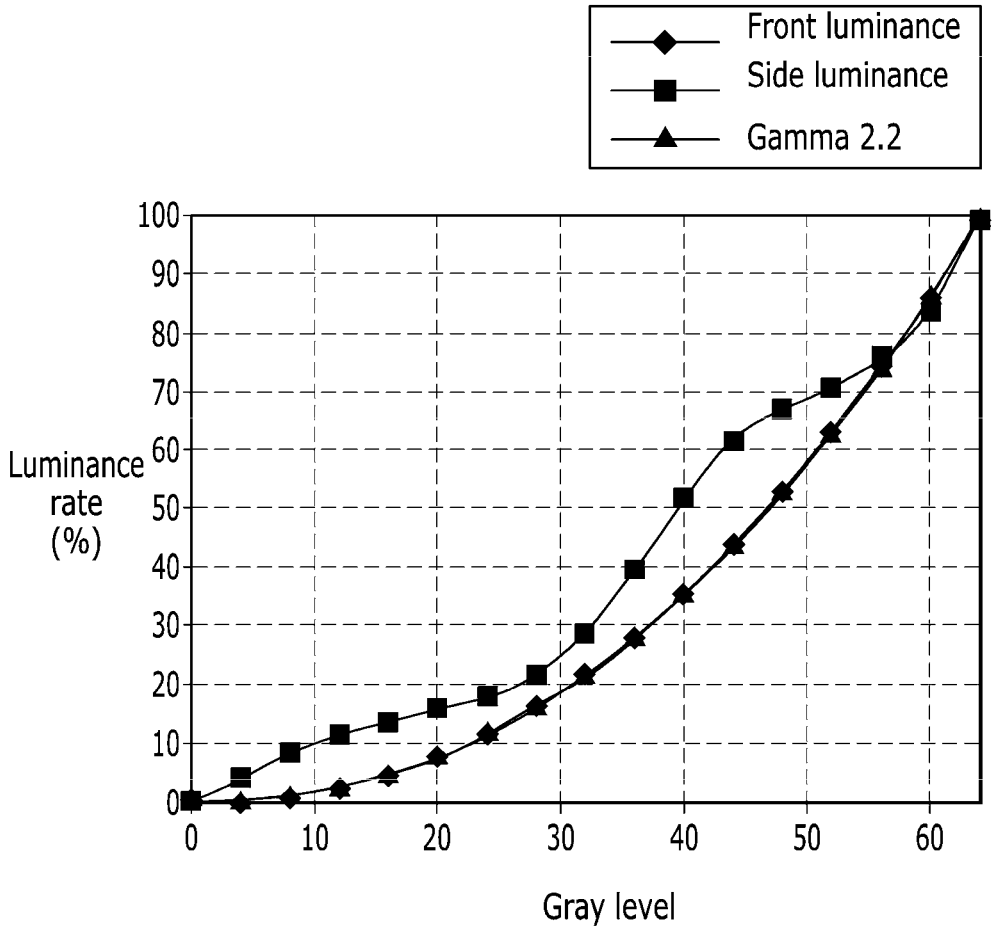
FIG. 15 is a graph showing a result of experimenting on front luminance and side luminance according to a gray level by applying a space division double gamma.

FIG. 14 is a graph showing a result of experimentation on a relation between the gray level and the liquid crystal driving voltage by using the space division double gamma. FIG. 15 is a graph showing a result of experimentation on front luminance rate and side luminance rate according to the gray level by using the space division double gamma.

Referring to FIGS. 14 and 15, if a first gamma Vd-A and a second gamma Vd-B are determined such that a product of the first gamma Vd_A and the second gamma Vd_B becomes 2.2 which is the reference gamma, as the liquid crystal driving voltage increases, a gray level according to the first gamma Vd_A and a gray level according to the second gamma Vd_B increase in different ways.

When the space division double gamma, which spatially divides and applies the first gamma Vd_A and the second gamma Vd_B to the spatially divided pixels respectfully, is applied, the front luminance increase rate is substantially the same as a luminance increase rate of the reference gamma 2.2. In contrast, the side luminance rate is higher than the luminance rate of the reference gamma 2.2 in low gray levels. A difference between the luminance rates of the side luminance and the front luminance is 23.2%.

Figure 16:
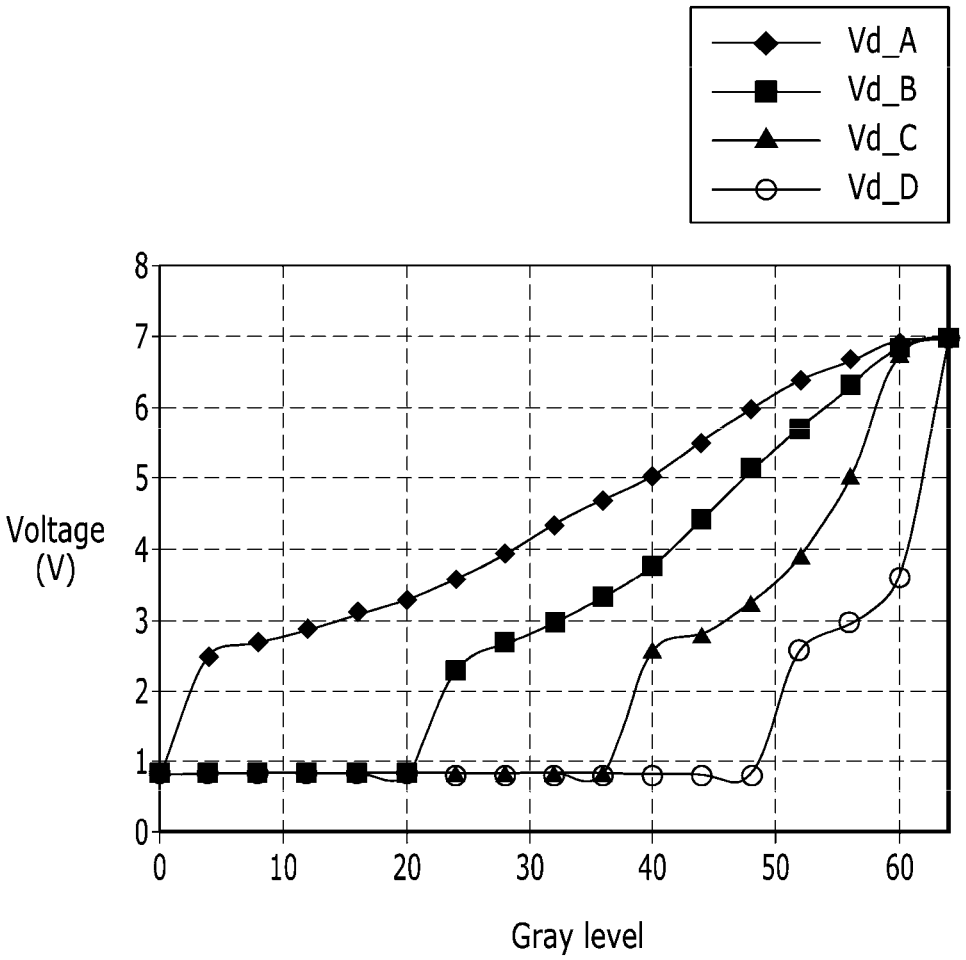
FIG. 16 is a graph showing a result of experimenting on a relation between a gray level and a liquid crystal driving voltage by applying a space division quadruple gamma.
Figure 17:
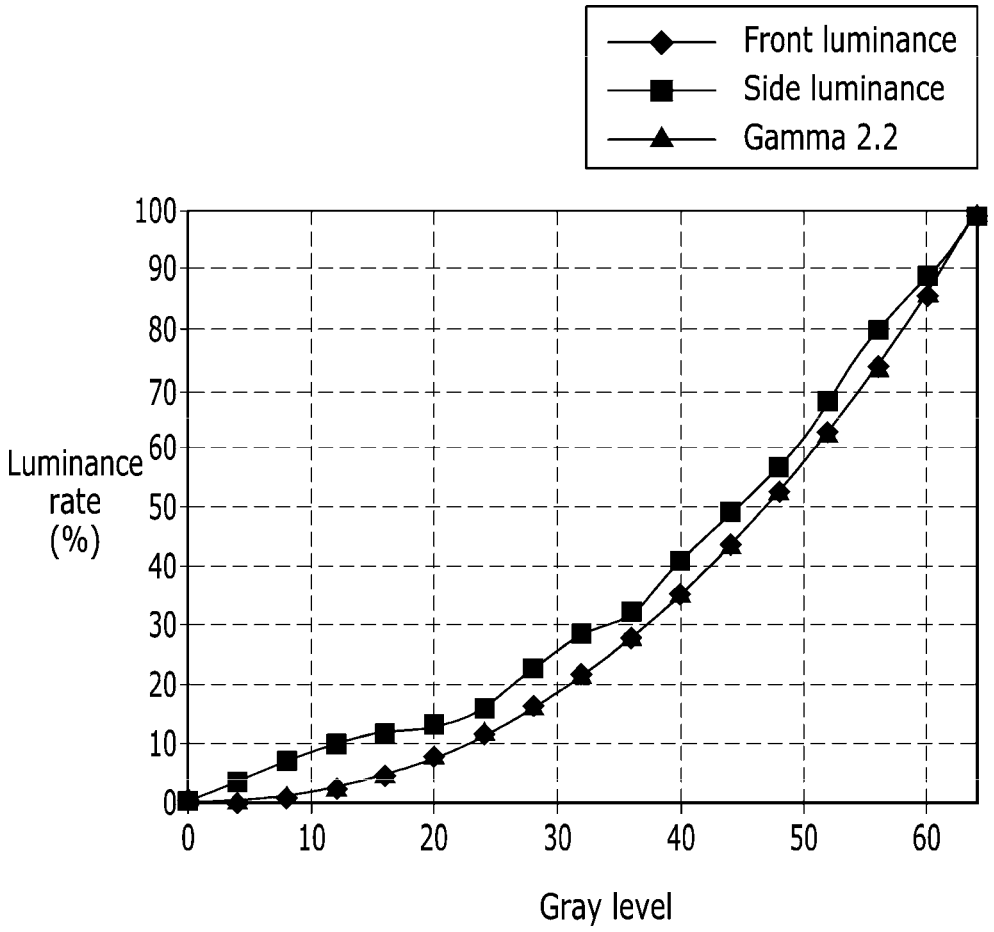
FIG. 17 is a graph showing a result of experimenting on front luminance and side luminance according to a gray level applying a space division quadruple gamma.

FIG. 16 is a graph showing a result of experimentation on a relation between the gray level and the liquid crystal driving voltage by using the space division quadruple gamma. FIG. 17 is a graph showing a result of measuring front luminance rate and side luminance rate according to the gray level by using the space division quadruple gamma.

Referring to FIGS. 16 and 17, if a first gamma Vd_A, a second gamma Vd_B, a third gamma Vd_C, and a fourth gamma Vd_D are determined such that a product of the first gamma Vd_A, the second gamma Vd_B, the third gamma Vd_C, and the fourth gamma Vd_D becomes the reference gamma 2.2, a gray level according to the first gamma Vd_A, a gray level according to the second gamma Vd_B, a gray level according to the third gamma Vd_C, and a gray level according to the fourth gamma Vd_D increase in different ways.

If the space division quadruple gamma, which spatially divides and applies the first gamma Vd_A, the second gamma Vd_B, the third gamma Vd_C, and the fourth gamma Vd_D, is applied, as the gray level increases, the front luminance increase rate is substantially the same as a luminance increase rate of the reference gamma 2.2. The side luminance rate is slightly higher than the luminance rate of the reference gamma 2.2. A difference between the luminance rates of the side luminance and the front luminance is 17.1%.

As described in FIGS. 12 to 17, the difference between the luminance rates of the side luminance and the front luminance may be reduced by using the double gamma. The difference between the luminance rates of the side luminance and the front luminance may be further reduced by using the quadruple gamma. In comparison with the case where the single gamma is applied, the difference between the luminance rates of the side luminance rate and the front luminance rate is reduced by 22.1% in the case where the quadruple gamma is applied, thereby improving the side visibility due to the reduction of the difference in the luminance rates.

The referred drawings and the detailed description of the inventive concept are only an example of the inventive concept and merely used for the purpose of describing the inventive concept and should not be used to limit the meaning or the scope of the inventive concept stated in the claims. Accordingly, it is understood by those skilled in the art that various modifications and other equivalent exemplary embodiments are possible. Therefore, the true technical protection range of the inventive concept should be determined by the technical spirit of the claims.

What is claimed is:

1. A display device comprising:

a similar gray level block detector configured to detect a pixel data block in which a gray level difference between a plurality of pixel data included in an image signal is smaller than or equal to a threshold;

a skin tone detector configured to detect the pixel data block including a skin tone; and a gamma processor configured to apply a first gamma to a plurality of pixel data included in the pixel data block when the pixel data block does not include the skin tone and apply a second gamma to the plurality of pixel data included in the pixel data block when the pixel data block includes the skin tone.

2. The display device of claim 1, wherein:

the first gamma is a single gamma including one gamma.

3. The display device of claim 2, wherein:

the second gamma is a multi gamma including a plurality of gammas.

4. The display device of claim 3, wherein:

the gamma processor applies different gammas to a plurality of subpixel data included in each of the plurality of pixel data when the pixel data block includes the skin tone.

5. The display device of claim 3, wherein:

the gamma processor applies a plurality of different first gammas to a plurality of subpixel data included in each of the plurality of pixel data during odd frames and applies a plurality of different second gammas to the plurality of subpixel data included in each of the plurality of pixel data during even frames.

6. The display device of claim 3, wherein:

a product of the plurality of gammas corresponds to a reference gamma value.

7. The display device of claim 1, wherein:

each of the plurality of pixel data includes a red gray level value, a green gray level value, and a blue gray level value, and the skin tone detector detects the pixel data block as the pixel data block including the skin tone when the red gray level value is larger than the green gray level value and the red gray level value is larger than the green gray level value.

8. The display device of claim 7, wherein:

the skin tone detector multiplies the green gray level value and the blue gray level value by a predetermined correction parameter respectively and compares them with the red gray level value.

9. The display device of claim 7, further comprising an HSV color space converter configured to convert an image signal to HSV data, wherein the skin tone detector detects whether hue and saturation is within a predetermined skin tone range in the HSV data.

10. The display device of claim 1, wherein:

the skin tone detector detects whether corresponding pixel data includes the skin tone based on whether or not a color histogram of each of the plurality of pixel data is included in a color distribution range indicating the skin tone.

11. The display device of claim 1, further comprising a still image detector configured to compare an image of a previous frame and an image of a current frame based on the image signal and detect whether a current image is a still image or a moving image.

12. The display device of claim 11, wherein:

when the current image is the still image, the gamma processor applies a first gamma to the plurality of pixel data during odd frames and applies a second gamma to the plurality of pixel data during even frames.

13. The display device of claim 11, wherein:

when the current image is the moving image, the gamma processor applies different gammas to a plurality of subpixel data included in each of the plurality of pixel data.

14. The display device of claim 1, further comprising:

an edge detector configured to detect an edge of an object having the skin tone in the pixel data block, wherein a gamma processor is configured to apply one of a single gamma and a multi gamma to the pixel data block having the skin tone.

15. A method of driving a display device, comprising:

detecting a pixel data block in which a gray level difference between a plurality of pixel data included in an image signal is equal to or smaller than a threshold;

detecting the pixel data block including a skin tone;

applying a first gamma to a plurality of pixel data included in the pixel data block when the pixel data block does not include the skin tone; and applying a second gamma to the plurality of pixel data included in the pixel data block when the pixel data block includes the skin tone.

16. The method of driving a display device of claim 15, wherein:

the applying the second gamma to the plurality of pixel data included in the pixel data block when the pixel data block includes the skin tone comprises applying different gammas to a plurality subpixel data included in each of the plurality of pixel data.

17. The method of driving a display device of claim 15, wherein:

the applying the second gamma to the plurality of pixel data included in the pixel data block when the pixel data block includes the skin tone comprises applying a plurality of different first gammas to the plurality of subpixel data included in each of the plurality of pixel data during odd frames and applying a plurality of different second gammas to the plurality of subpixel data included in each of the plurality of pixel data during even frames.

18. The method of driving a display device of claim 15, wherein:

the applying the second gamma to the plurality of pixel data included in the pixel data block when the pixel data block includes the skin tone comprises applying the first gamma to the plurality of subpixel data included in each of the plurality of pixel data during odd frames and applying the second gamma to the plurality of subpixel data included in each of the plurality of pixel data during even frames.

19. The method of driving a display device of claim 15, further comprising:

comparing an image of a previous frame and an image of a current frame based on an image signal and detecting whether a current image is a still image or a moving image, wherein the applying the second gamma to the plurality of pixel data included in the pixel data block when the pixel data block includes the skin tone comprises applying the first gamma to the plurality of pixel data during odd frames and applying the second gamma to the plurality of pixel data during even frames when a current image is a still image.

20. The method of driving a display device of claim 19, wherein:

the applying the second gamma to the plurality of pixel data included in the pixel data block when the pixel data block includes the skin tone comprises applying different gammas to a plurality of subpixel data included in each of the plurality of pixel data when the current image is a moving image.

* * * * *